US005794937A

United States Patent [19]

Robbs, III

[11] Patent Number: 5,794,937

[45] Date of Patent: Aug. 18, 1998

[54] APPARATUS AND METHOD FOR USE IN A HAND GAME

[75] Inventor: Albert Alexander Robbs, III, Redondo Beach, Calif.

[73] Assignee: Tom Thumb Toys, Las Vegas, Nev.

[21] Appl. No.: 667,941

[22] Filed: Jun. 24, 1996

[51] Int. Cl.[6] ..... A63B 67/00

[52] U.S. Cl. ..... 273/447

[58] Field of Search ..... 273/447, 448, 273/452, 453, 346, 67 B; 473/212, 213

[56] References Cited

U.S. PATENT DOCUMENTS

| | | | |
|---|---|---|---|
| 1,637,278 | 7/1927 | Renz | 273/67 B X |
| 3,762,719 | 10/1973 | Smith | 473/212 |
| 4,257,607 | 3/1981 | Nedwick | 473/212 |
| 5,316,294 | 5/1994 | Turangan | 273/65 |
| 5,335,916 | 8/1994 | Nee | 273/346 |

*Primary Examiner*—William H. Grieb
*Attorney, Agent, or Firm*—Charles F. Reidelbach, Jr.

[57] ABSTRACT

The present invention pertains generally to game devices and methods, and provides an apparatus for use in a hand game played by at least two players, hereinafter respectively referred to as the first and second players. The apparatus includes a harness secured to at least one hand of the first player and a capture object selectively positioned proximate to the harness and which is removable from the harness by the second player during play of the game. The present invention also contemplates a game which includes an offensive player and a defensive player, each player having a left and right hand, and each hand having an outer and inner surface. A left and right harness are respectively secured on the left and right hands of the offensive player. A left and right capture object are respectively positioned proximate to the left and right harnesses. Finally, the present invention contemplates a method for playing a game which includes various steps including the steps of: securing a harness to a playing hand of the first player; selectively positioning a capture object on the harness; placing at least one playing hand of the first player proximate to at least one playing hand of the second player; and attempting to capture the object by the second player from the first player.

7 Claims, 4 Drawing Sheets

APPARATUS AND METHOD FOR USE IN A HAND GAME

FIELD OF THE INVENTION

The present invention pertains generally to game devices and methods, and more particularly to games utilizing the hand or hands of at least two players. The present invention enhances the pre-existing concepts of hand games by incorporating an apparatus for use during play of a variety of hand games.

BACKGROUND OF THE INVENTION

There are a variety of well known hand games which are commonly and widely utilized by children and adults alike. The games of arm wrestling, thumb wrestling, and smash are just a few games which are simple, inexpensive and easy to play. Some games, such as smash, have proven effective in increasing skills such as the eye-hand coordination of the player.

The game and rules of smash are described in "*The Hand Book; All Kinds of Jokes, Tricks & Games To Do With Your Hands,*"pp. 46–48, Lassor A. Blumenthal, Doubleday & Company, Inc., Garden City, N.Y., 1976. To summarize, the game is played by two players known as the first player and the second player, who may either stand or sit during the game. Initially, the first player extends its hands away from its body and positions its hands so that the palms of each hand are facing upward. In a similar fashion, a second player extends its hands away from its body but lightly rests its palms downward on top of the first player palms. Quickly, the first player attempts to slap the backside of the second player's hands. Consequently, it is the object of the second player to prevent the first player from slapping their hands by pulling the first player's hands away before contact.

The basic game strategy can become more sophisticated by implementing the hand slapping combinations listed below:

(a) The first player's right hand slaps the second player's left hand;

(b) The first player's left hand slaps the second player's right hand;

(c) The first player's right hand slaps the second player's right hand;

(d) The first player's left hand slaps the second player's left hand;

(e) The first player's left and right hands simultaneously slap the second player's left and right hands.

Aside from being fun and entertaining, the game of smash tests the players speed and quickness and provides increased eye-hand coordination function. Yet despite its proven advantages, there are several drawbacks which a player may experience when playing the game.

One such drawback is the uncomfortable and often painful effects which result from play. These side effects are inherent as the game is based on the velocity or swiftness by which one player's hand slaps the other player's hand. This problem can easily rise to a level of safety concern especially when the game is played by young children of differing ages or capabilities (such as strength). Another drawback associated with the game of smash or a similar variation is the lack of educational value and content. Finally, it is sometimes difficult to determine whether a hand actually physically touched the opponent's hand, often resulting in an unpleasant argument.

Consequently, there is a need for an improved hand game which eliminates the painful slapping and anticipated argument associated with the above described hand game of smash. Additionally, there is a need for a hand game which provides greater educational value yet maintains the advantages and benefits above mentioned.

SUMMARY OF THE INVENTION

It is the object of the present invention to provide an improved hand game device and method which is safe and eliminates the painful slapping and resulting risk of injury associated with well known hand games.

It is another object of the present invention to provide an improved hand game device and method which provides improved scoring clarity thus minimizing anticipated arguments as to whether a point was scored or a hand was slapped.

It is yet another object of the present invention to provide an improved hand game device and method which provides greater educational value to children.

It is another object of the present invention to provide an improved hand game device and method which is attractive to children and adults alike, and allows for the marketing and commercialization of trademarks and copyrighted characters.

Finally, it is an object of the present invention to provide the above mentioned improvements yet is simple and inexpensive.

These and other objects are achieved in accordance with the present invention by providing an apparatus for use in a hand game played by at least two players, hereinafter respectively referred to as the first and second players. The apparatus includes two main components: (1) a harness secured to at least one hand of the first player; and (2) a capture object selectively positioned proximate to the harness and which is removable from the harness by the second player during play of the game. The capture object is secured to said harness by a mechanism such as a hook and loop system, an adhesive, a snap or snaps, magnetics, electrostatics, or suction.

More specifically, the object is placed on the mounting area of the harness which may be positioned proximate to the outer surface of the first player's hand. Alternatively, the player's hands may be constricted in a fist-shaped position and the object placed on the first players thumb or the area surrounding the thumb. The harness may be configured in a variety of design and materials, such as a resilient band, a hand strap, or a glove which surrounds the hand of the first player. The capture object is preferably lightweight having a predefined and predetermined shape.

Although only one hand of each player is necessary to practice the present invention, it is contemplated that both hands of each player may be simultaneously used to fully appreciate the challenge presented by the present invention. If both hands of each player are utilized, each hand of the first player would be provided with a harness and a selectively positioned object.

The present invention also contemplates a game which includes an offensive player and a defensive player, each player having a left and right hand, and each hand having an outer and inner surface. A left harness and a right harness are respectively secured on the left and right hands of the offensive player. A left capture object and a right capture object are respectively positioned proximate to the left and right harnesses.

In describing the positioning, the left and right hands of the offensive player are respectively placed proximate to the left and right hands of the defensive player. It is the object of the defensive player to attempt to capture at least one capture object from the offensive player.

In describing the positioning, the inner surfaces of the left hand and the right hand of the offensive player are respectively placed proximate the outer surfaces of the left hand and the right hand of the defensive player. Alternatively, the inner surfaces of the left hand and the right hand of the offensive player are respectively placed proximate to the inner surfaces of the left hand and the right hand of the defensive player.

In yet another position, each hand of each player may be constricted in a fist-like position and positioned one above the other.

Finally, the present invention contemplates a method for playing a game which includes various steps. The most significant steps in the method include the following:

(1) providing a first or offensive player and second or defensive player, each player having at least one playing hand;

(2) securing a harness to at least one playing hand of the first player;

(3) selectively positioning a capture object on the harness;

(4) placing at least one playing hand of the first player proximate to at least one playing hand of the second player; and (5) attempting to capture the capture object from the first player by the second player.

The method continues with the steps of:

(6) scoring a predetermined value when the second player captures the capture object from the first player; and (7) trading playing positions between the first and second players when the second player accumulates a predetermined score value or the second player fails to capture the capture object from the first player.

Further detail regarding the game apparatus and method in accordance with the present invention may be had with reference to the detailed description which is provided below, taken in conjunction with the following illustrations.

DETAILED DESCRIPTION OF THE PREFERRED EMBODIMENT

Figure 1:
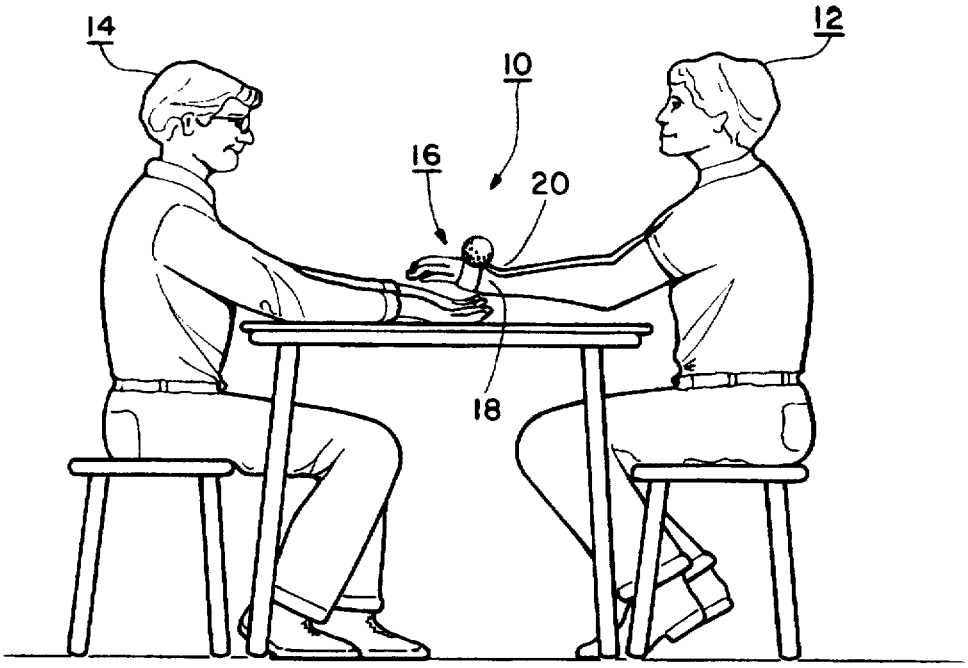
FIG. 1 is a perspective view of the game environment and player positions in the present invention.

The general environment of the preferred embodiment of the present invention is shown and illustrated in FIG. 1. A game 10 is shown which may be played by at least two players 12, 14, hereinafter respectively referred to as the first 12 and second 14 players.

Figure 2A:
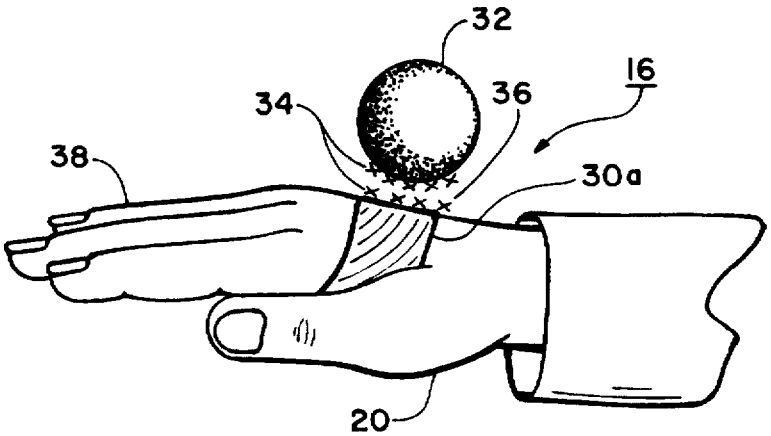
FIG. 2A is a perspective view illustrating the first player's hand and the associated harness configured as a band for securing the object.
Figure 2B:
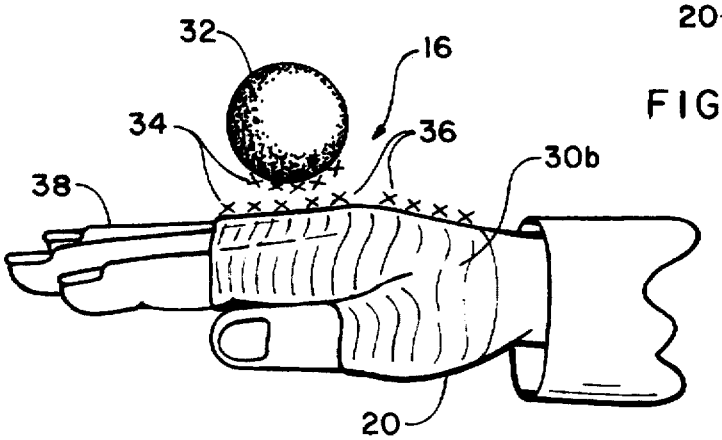
FIG. 2B is a perspective view illustrating the first player's hand and the associated harness configured as a finger less glove for securing the object.
Figure 2C:
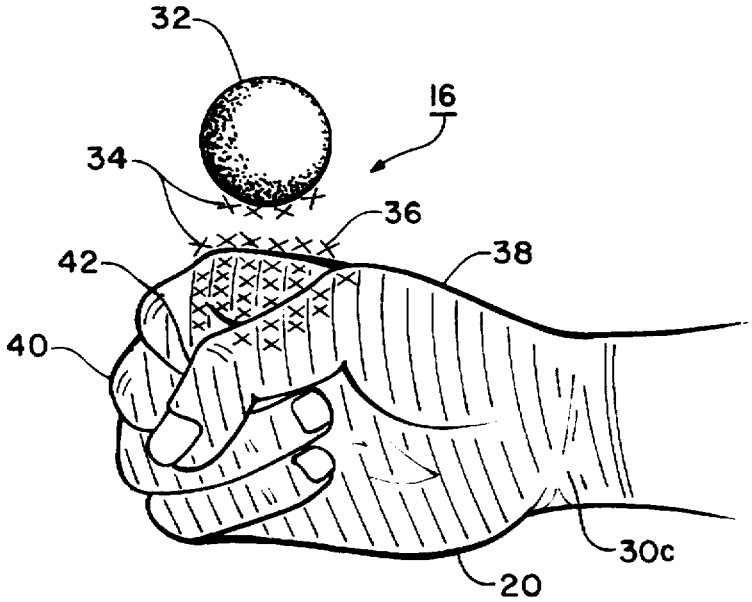
FIG. 2C is a perspective view illustrating the first player's hand in a contracted fist-like position, and the associated harness configured as a glove.

An apparatus 16 surrounding the respective hands 18, 20 of player 12 is shown generally in FIG. 1, and more specifically in FIGS. 2A–C. As shown in FIGS. 2A–C, the apparatus 16 includes two main components: (1) a harness 30*a–c* secured to at least one hand 18, 20 of the first player 12; and (2) a capture object 32 selectively positioned proximate to the harness 30 and which is removable from the harness 30 by the second player 14 during play of the game 10.

The capture object 32 is secured to the harness 30 by a mechanism 34 such as a hook and loop system, an adhesive, a snap or snaps, magnetics, electrostatics, or suction. More specifically, the object 32 is placed on the mounting area 36 of the harness 30 which may be positioned proximate to the outer surface 38 of the first player's hand 20.

The harness 30 may be provided in a variety of embodiments, some of which are illustrated in FIGS. 2A–C. For example, referring specifically to FIG. 2A, the harness 30 may be a band 30*a* preferably made of a resilient material such as elastic or rubber for comfort and ease of use. FIG. 2B illustrates the use of a fingerless glove 30*b* as the harness 30 for securing object 32. The glove 30*b* resembles a commonly used weight lifting glove and may be made from any suitable material.

Finally, FIG. 2C illustrates the use of yet another glove configuration 30*c* extending over the entire hand and beyond. Although only three embodiments are illustrated, they are inclusive rather than exclusive as the present invention contemplates a variety of harness 30 configurations and materials.

Referring again to FIG. 2C, rather than extending the hand horizontally as shown in FIGS. 2A and 2B, the players' hands 18, 20 may be constricted in a fist-shaped position 40 and the object 32 placed proximate to or on the first player's 12 thumb 42.

It is the intent of the present invention to provide a capture object 32 which is lightweight and has a variety of predefined and predetermined shapes. More specifically, the present invention contemplates the use of the capture object 32 as an entertainment and/or educational medium or device. For example, the capture object 32 may be shaped as a square, rectangle, triangle, or any other suitable shape for assisting the player or players in learning various geometrical representations. Additionally, the capture object 32 may be formed of various letters and alphabets for assisting the player or players in learning various languages. The rules of the game 10 could easily be modified to incorporate these educational activities.

It is also the intention of the present invention to provide increased attractiveness to children and adults alike, by allowing for the marketing and commercialization of creative trademarks and copyrighted characters. For example, the capture object 32 may be any well known entertainment character or company logo for which marketing by the rightful owner is desired.

The present invention also contemplates the implementation of high technology to the apparatus 16 and game 10. For example, sounds may be produced upon certain critical events during game play. For example, a series of sounds could be provided when the capture object 32 is removed from the mounting area 36, or upon various other circumstances.

Although only one hand 18, 20, 22, 24 of each player 12, 14 is necessary to practice the present invention, it is contemplated that both hands of each player may be used to fully appreciate the present invention. If both hands 18, 20, 22, 24 of each player 12, 14 are utilized, each hand 18, 20 of the first player 12 would be provided with a harness 30 and selectively positioned object 32.

Referring briefly to FIG. 1, a game 10 is provided which illustrates the first player 12 as an offensive player and the second player 14 as a defensive player.

Figure 3A:
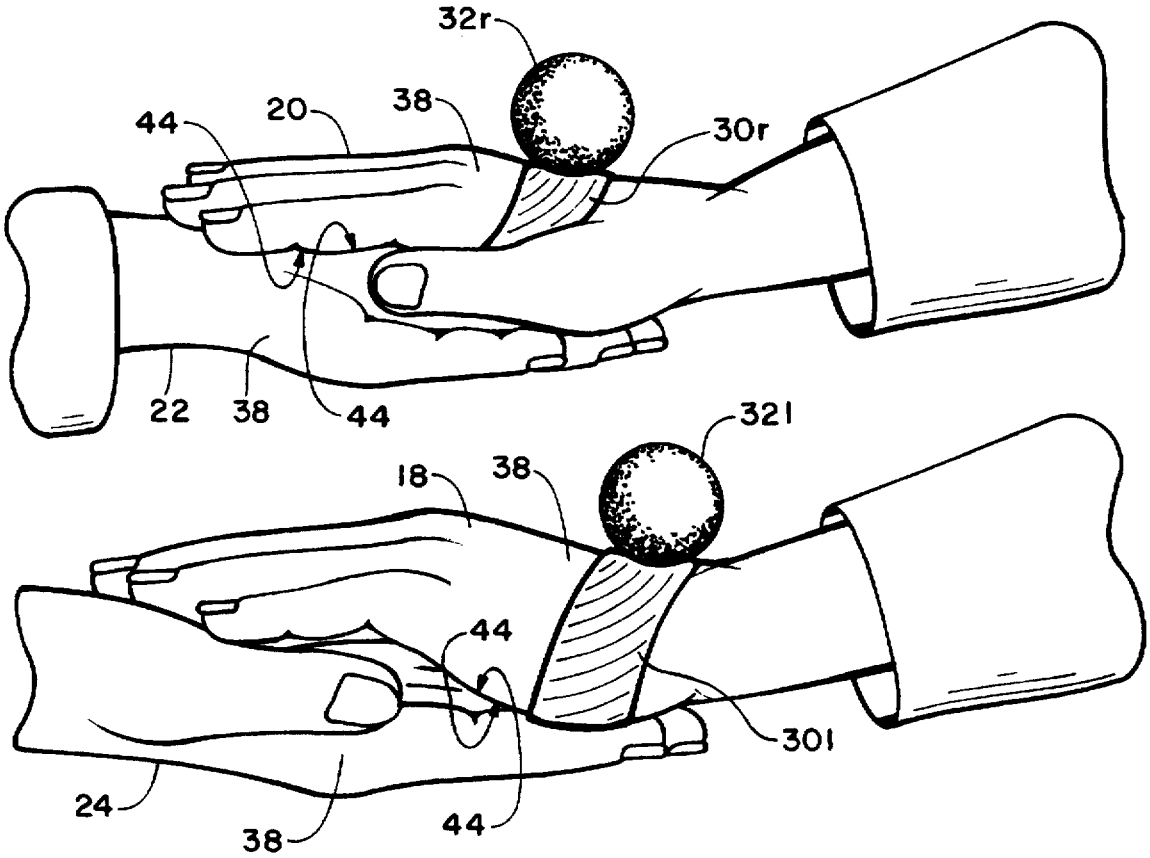
FIG. 3A is a perspective view of the players initial hand positions in one implementation of the game.
Figure 3B:
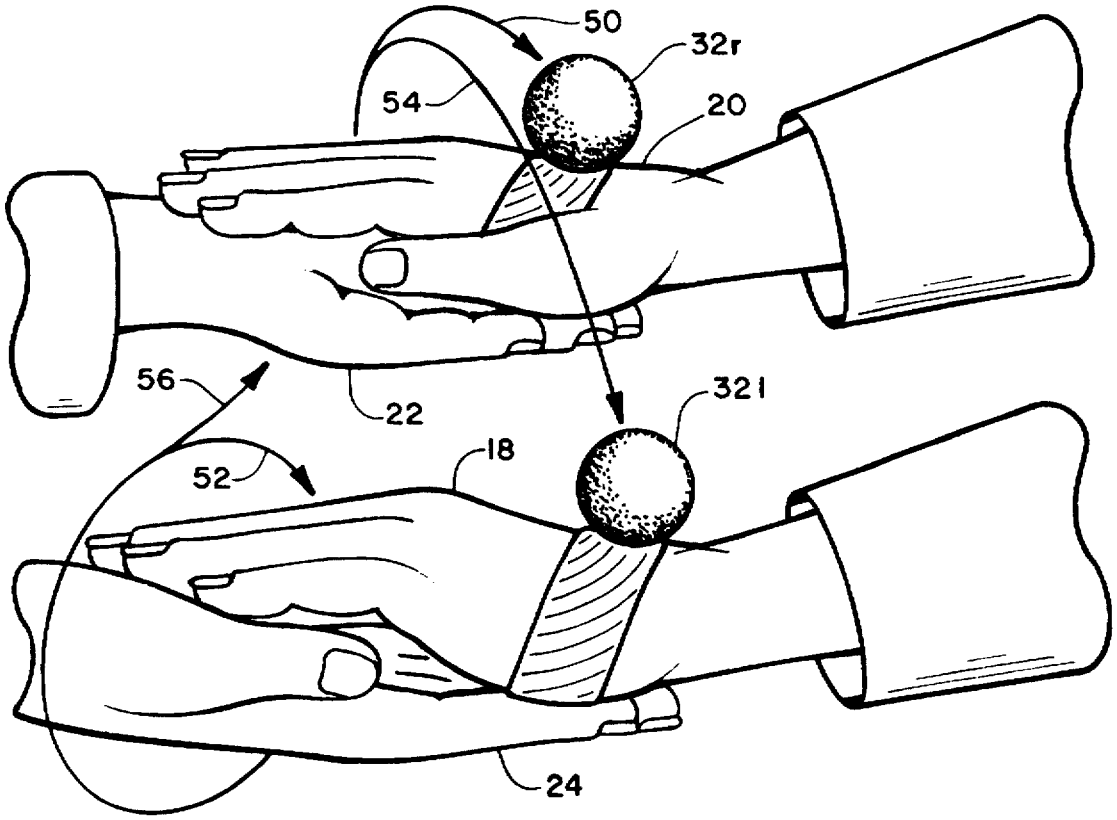
FIG. 3B is a perspective view illustrating the possible course of hand movement during the object capturing attempt.

Turning now to FIGS. 3A–E, specifically FIG. 3A, each player 12, 14 has a left hand 18, 22, and right hand 20, 24, and each hand 18, 20, 22, 24, has an outer surface 38 and inner surface 44. A left harness 301 and a right harness 30*r* are respectively secured on the left and right hands 18, 20 of the offensive player. A left capture object 321 and a right capture object 32*r* are respectively positioned proximate to the left and right harnesses 301, 30*r*.

In describing the positioning, the left and right hands 18, 20, of the offensive player are respectively placed proximate to the left and right hands 22, 24 of the defensive player. It is the object of the defensive player to attempt to capture at least one capture object 32*l*, 32*r*, from the offensive player.

The preferred positioning of the players hands 18, 20, 22, 24, is illustrated in FIG. 3A. Specifically, the inner surfaces 44 of the left hand 18 and the right hand 20 of the offensive player is respectively placed proximate the inner surfaces 44 of the left hand 22 and the right hand 24 of the defensive player. Although not shown, it is within the scope of the present invention that the inner surfaces 44 of the left hand 18 and the right hand 20 of the offensive player be respectively placed proximate to the outer surfaces 38 of the left hand 22 and the right hand 24 of the defensive player.

Figure 4:
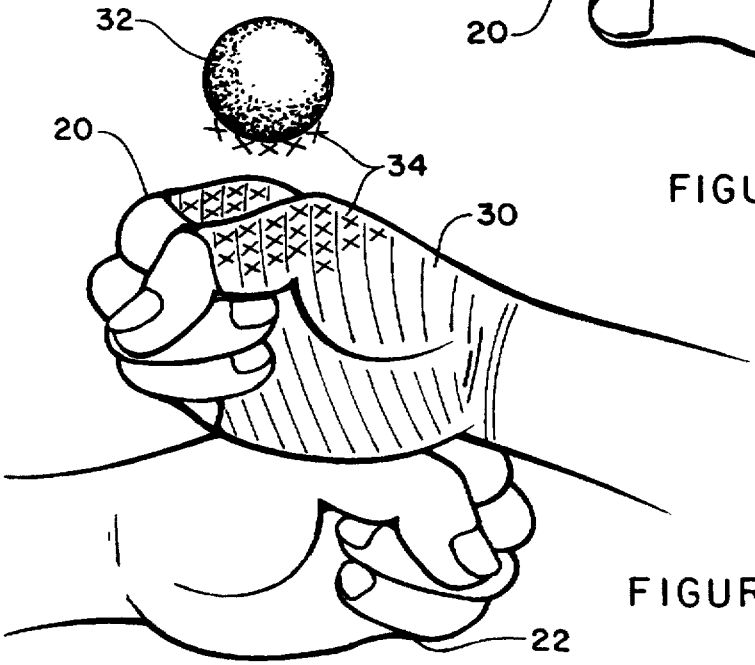
FIG. 4 is an alternative hand game position.

The above mentioned preferred positioning is only one of many possible variations of hand positioning contemplated by the present invention. Turning momentarily to FIG. 4, the hands 18, 20, 22, 24 of both players 12 and 14 may be maintained in a constricted fist-like position and selectively positioned one above the other. For example, the offensive player may be positioned proximate and above the defensive player or proximate and below the defensive player.

Finally, the present invention contemplates a method for playing a game which includes various steps as illustrated in FIGS. 3A–E. The first several steps are basic and are believed to be understandable by simply referring to FIG. 3A. The first and most basic step includes providing a first player 12 and a second player 14 as described previously with respect to FIG. 1. As described, it is anticipated that each player have at least one available playing hand. Although not necessary, the first player 12 is preferably an offensive player and the second player 14 is preferably a defensive player. It should be noted however, that the first player 12 may simultaneously be both an offensive player and a defensive player, depending on the number, arrangement and positioning of each players hand 18, 20, 22, 24. In the present embodiment, the offensive player is defined as the player who maintains the object 32 and the defensive player is the player who seeks the capture of the object 32.

The step of providing at least two players is followed by the step of securing a harness 30 to at least one playing hand 18, 20 of the first player 12. Once the harness 30 is secured, the next steps include selectively positioning a capture object 32 on the harness 30 and placing at least one playing hand 18, 20 of the first player 12 proximate to at least one playing hand 22, 24 of the second player 14.

Once the preferred hand positioning is established, the method continues with the step of attempting by the second player 14 to capture at least one capture object 32 from the first player 12. This step is best illustrated by viewing FIG. 3B. As shown, it is an object of the second player 14 to move their left hand 22 in a direction 50 or any similar variation thereof, to a position above the right hand 20 of the first player 12 in which to capture or have access to capture object 32*r*.

In a similar fashion, it is an object of the second player 14 to move their right hand 24 in a direction 52 or any similar variation thereof, to a position above the left hand 18 of the first player 12 in which to capture or have access to capture object 32*l*.

It may be a further object of the second player 14 to move their left hand 22 in a direction 54 or any similar variation thereof, to a position above the left hand 18 of the first player 12 so as to capture or have opportunity to capture object 32*l*.

It may be yet another object of the second player 14 to move their right hand 24 in a direction 56 or any variation thereof so as to capture or provide the opportunity to capture object 32*r*.

Figure 3C:
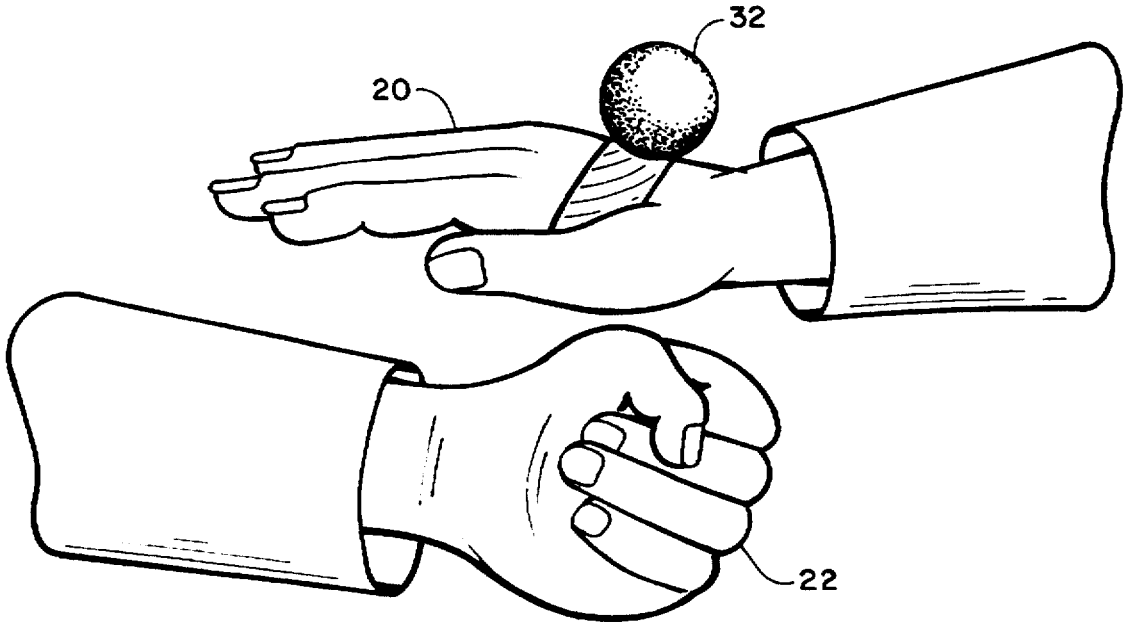
FIG. 3C is a perspective view illustrating the resulting position if the second player fails to capture or strike the object.
Figure 3D:
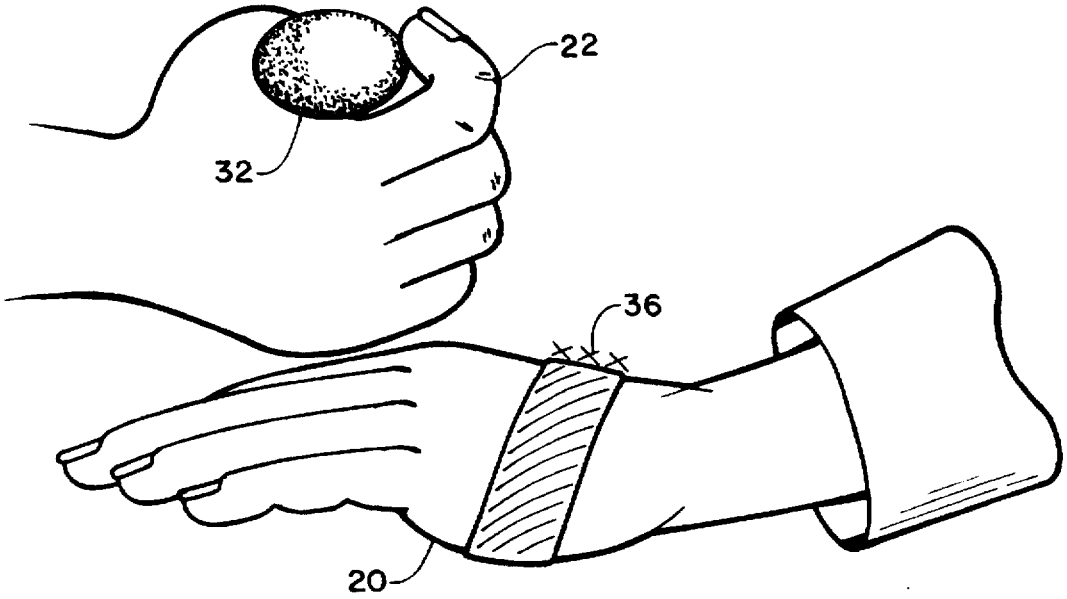
FIG. 3D is a perspective view illustrating the resulting position if the second player captures the object from the harness.

The step of attempting to capture the capture object 32 results in one of three possible states. The three states are shown in FIGS. 3C–D. The first possible state, illustrated in FIG. 3C, is the unsuccessful capturing of the capture object 32. In fact, in this second state, the second player 12 has not made any contact with the capture object 32.

The second possible state, illustrated in FIG. 3D, is the successful accomplishment of capturing the capture object 32 during the above described attempt.

Figure 3E:
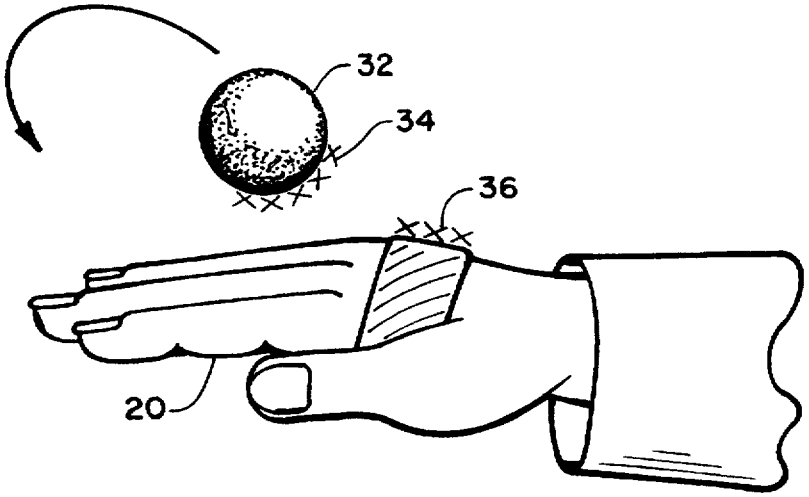
FIG. 3E is a perspective view illustrating the resulting position if the second player fails to capture but strikes the object from the harness.

In the third possible state, illustrated in FIG. 3E, is the unsuccessful capturing of the capture object 32, yet the capture object 32 is stricken loose by the first player 12 during the above mentioned attempt.

The result of the previous step of attempting is followed with the step of scoring a predetermined value in the second player's favor when the second player 14 captures the capture object from the first player. Alternatively, the step of scoring a predetermined value could be given in the first player's favor when the second player 14 fails to capture the capture object from the first player 12. There are just a few variations of attributing a predetermined value in the establishment of a scoring system for the game.

The method concludes with the step of trading playing positions between the first and second players when the second player 14 or the first player 12 accumulates a preselected or predetermined score value.

It will therefore be understood that various changes in the details, materials and arrangement of parts which have been herein described and illustrated in order to explain the nature of the invention may be made by those skilled in the art within the principal and scope of the invention as expressed in the following claims.

I claim:

1. A method for playing a game which comprises the steps of:

providing a first and second player, each said player having at least one playing hand;

securing a harness to said at least one playing hand of said first player;

selectively positioning a capture object on said harness;

placing said at least one playing hand of said first player proximate to said at least one playing hand of said second player; and attempting to capture said capture object from said first player by said second player.

2. A method as recited in claim 1, further comprising the step of scoring a predetermined value when said second player captures said capture object from said first player.

3. A method as recited in claim 2, wherein the step of providing a first player and a second player is the step of providing an offensive player and a defensive player respectively.

4. A method as recited in claim 2, further comprising the step of trading playing positions between said first and second players when said second player accumulates a predetermined score value.

5. A method as recited in claim 1, further comprising the step of trading playing positions between said first and second players when said second player fails to capture said capture object from said first player.

6. A method for playing a game between two or more players, comprising the steps of:

providing a first and second player, each of the players having a playing hand;

securing a harness to the playing hand of the first player;

positioning an object on the harness;

placing the playing hand of the first player proximate to the playing hand of the second player; and attempting to remove the object on the harness by the playing hand of the second player during play of the game.

7. A method for playing a game comprising the steps of:

providing an offensive player and a defensive player, each player having a left hand and a right hand;

securing a left harness and a right harness on the left hand and the right hand of the offensive player, respectively;

positioning an object on the left and right harness;

placing the left and right hands of the offensive player proximate to the right and left hands of the defensive player, respectively; and attempting to remove the objects from the left and right harness by the defensive player.

* * * * *